United States Patent [19]

Takai

[11] Patent Number: 4,727,009

[45] Date of Patent: Feb. 23, 1988

[54] ELECTROPHOTOGRAPHIC PHOTOSENSITIVE MEMBER HAVING TWO CHARGE TRANSPORT LAYERS DIFFERING IN OXIDATION POTENTIALS

[75] Inventor: Hideyuki Takai, Yokohama, Japan

[73] Assignee: Canon Kabushiki Kaisha, Tokyo, Japan

[21] Appl. No.: 16,776

[22] Filed: Feb. 20, 1987

[30] Foreign Application Priority Data

Feb. 25, 1986 [JP] Japan ..... 61-038312

[51] Int. Cl.[4] ..... G03G 5/14

[52] U.S. Cl. ..... 430/58; 430/59

[58] Field of Search ..... 430/58, 59

[56] References Cited

U.S. PATENT DOCUMENTS 3,997,342 12/1976 Bailey ..... 430/83

*Primary Examiner*—J. David Welsh

*Attorney, Agent, or Firm*—Fitzpatrick, Cella, Harper & Scinto

[57] ABSTRACT

An electrophotographic photosensitive member comprises a conductive support, and at least a charge generation layer, a first charge transport layer containing a charge transporting material, and a second charge transport layer containing a charge transporting material having higher oxidation potential than that of the charge transporting material contained in said first charge transport layer, which layers are successively laminated on said conductive support.

8 Claims, No Drawings

ELECTROPHOTOGRAPHIC PHOTOSENSITIVE MEMBER HAVING TWO CHARGE TRANSPORT LAYERS DIFFERING IN OXIDATION POTENTIALS

BACKGROUND OF THE INVENTION

1. Field of the Invneiton

The present invention relates to an electrophotographic photosensitive member, and, particularly, to a function-separated type electrophotographic photosensitive member improved in image stability and potential stability.

2. Related Background Art

As electrophotographic photosensitive members comprising inorganic photoconductive materials, conventionally used are those employing selenium, cadmium sulfide, zinc oxide and so forth.

As electrophotographic photosensitive members comprising organic photoconductive materials, on the other hand, known are those employing a photoconductive polymer typified by poly-N-vinyl carbazole or a low molecular organic photoconductive material such as 2,5-bis(p-diethylaminophenol)-1,3,4-oxadiazole, or those wherein such organic photoconductive materials are combined with a variety of dyes or pigments.

The electrophotographic photosensitive members employing organic photoconductive materials are advantageous in that they have good film-forming properties and can be produced by coating to have very high productivity to provide photosensitive members inexpensively. They are also advantageous in that the color-sensitivity can be controlled as desired, by selecting sensitizers such as dyes or pigments to be used, and therefore studies have hitherto been made in a wide range. Particularly in recent years, function-separated type photosensitive members employing an organic photoconductive pigment in a charge generation layer and laminated with a so-called charge transport layer comprising the above photoconductive polymer or low molecular organic photoconductive material, have been developed to have remarkably improved the sensitivity and durability in which the conventional organic electrophotographic photosensitive members have been considered defective, and they have been put into practical use. Moreover, various compounds and pigments suited to the function-separated type photosensitive members have been discovered.

However, such function-separated type photosensitive members are disadvantageous in that a charge transporting material present in the charge transport layer constituting the surface layer of the photosensitive member is subject to adsorption of, or oxidation by, active components such as ozone generated by corona discharge, to cause a blur of an image when used repeatedly or cause a background fog of an image due to the accumulation of residual potential.

SUMMARY OF THE INVENTION

An object of the present invention is to provide an electrophotographic photosensitive member suffering less blur of image or accumulation of residual potential caused, during repeated use, by the action of such active components generated upon corona discharge, and simultaneously having a high sensitivity.

To achieve this object, the present inventors have made intensive studies on the charge transporting material, and, as a result, have found that there is caused less blur of image or accumulation of residual potential if a charge transporting material having higher oxidation potential is used. However, in general, when a material having high oxidation potential is used as the charge transporting material, the injection performance of a carrier from the charge generation layer to the charge transport layer may be lowered to decrease the sensitivity at an initial stage, and thus there was room for further improvement.

Then, as a result of further studies, they have found that the blur of image or accumulation of residual potential can be lessened without causing the lowering of the sensitivity, by laminating on the surface of the usual charge transport layer a charge transport layer containing the charge transporting material having such high oxidation potential. The present invention has been thus accomplished.

According to the present invention, there is provided an electrophotographic photosensitive member comprising a conductive support, and at least a charge generation layer, a first charge transport layer containing a charge transporting material and a second charge transport layer containing a charge transporting material having higher oxidation potential than that of the charge transporting material contained in said first charge transport layer, which layers are successively laminated on said conductive support.

The electrophotographic photosensitive member of the present invention will be described below in greater detail.

DESCRIPTION OF THE PREFERRED EMBODIMENTS

As a charge generating material, there can be used azo pigments, phthalocyanine pigments, quinacridone pigments, cyanine pigments, pyrylium pigments, thiapyrylium pigments, indigo pigments, squaric acid pigments, polycyclic quinone pigments, etc. These pigments may be dispersed together with a suitable binder resin solution to make a finely particulate dispersion.

As a solvent for dispersing the pigments, there can be used solvents of various types including alcohol type solvents such as methanol, ethanol and IPA; ketone type solvents such as acetone, MEK, MTBK and cyclohexanone; aromatic solvents such as benzene, toluene, xylene and chlorobenzene; amide type solvents such as DMF and DMAC; cyclic ether type solvents such as THF and 1,4-dioxane; etc. Dispersion can be carried out by utilizing dispersion means such as a sand mill, a colloid mill, and attritor and a ball mill.

The binder resin to be used may include polyvinyl butyral, formal resins, polyamide resins, polyurethane resins, cellulose resins, polyester resins, polysulfone resins, styrene resins, polycarbonate resins, acrylic resins, etc.

The charge generation layer can be formed applying, by coating, the above dispersion on a conductive support directly or through a subbing layer. The charge generation layer may have a layer thickness of 5 μm or less, preferably from 0.01 to 1 μm to provide a thin film layer, desirably. It is required that most part of the amount of incident light is absorbed in the charge generation layer so that a large number of charge carriers can be formed, and also the charge carriers generated are injected in the charge transport layer without deactivation due to recombination or trapping. Therefore, it is preferable for the layer to have the above film thickness.

Coating can be carried out by using coating methods such as dip coating, spray coating, spinner coating, bead coating, Meyer bar coating, blade coating, roller coating and curtain coating. Drying is preferably carried out by set to tough drying at room temperature, followed by heat drying. The heat drying can be carried out at a temperature of 30 ° C. to 200 ° C. for a period ranging between 5 minutes and 2 hours in a stationary state or under ventilation.

The charge transport layer is provided on the above charge generation layer, and has a function to receive charge carriers injected from the charge generation layer in the presence of the electric field, and also to transport these charge carriers to the surface. Charge transporting material includes an electron transporting material and a hole transporting material. The electron transporting material may include electorn attractive materials such as chloranil, bromanil, tetracyanoethylene, tetracyanoquinodimethane, 2,4,7-trinitro-9-fluorenone, 2,4,5,7-tetranitro-9-fluorenone, 2,4,7-trinitro9-dicyanomethylenefluorenone, 2,4,5,7-tetranitroxanthone, 2,4,8-trinitrothioxanthone, etc. or those obtained by polymerizing these electron attractive materials.

The hole transporting material may include pyrene, N-ethylcarbazole, N-isopropylcarbazole, N-methyl-N-phenylhydrazino-3-methylidene-9-ethylcarbazole, N,N-diphenylhydrazino-3-methylidene-9-ethylcarbazole, N,N-diphenylhydrazino-3-methylidene-10-ethylphenothiazine, N,N-diphenylhydrazino-3-methylidene-10-ethylphenoxazine, hydrazones such as p-diethylaminobenzaldehyde-N,N-diphenylhydrazone, p-diethylaminobenzaldehyde-N-α-naphthyl-N-phenylhydrazone, p-pyrolidinobenzaldehyde-N,N-diphenylhydrazone, 1,3,3-trimethylindolenine-ω-aldehydo-N,N-diphenylhydrazone and p-diethylbenzaldehydo-3-methylbenzthiazolinon -2-hydrazone, 2,5-bis(p-diethylaminophenyl)-1,3,4-oxadiazole, pyrazolines such as 1-phenyl-3-(p-diethylaminostyryl)-5-(p-diethylaminophenyl)pyrazoline, 1-[quinolyl(2)]-3-(p-diethylaminostyryl)-5-(p-diethylaminophenyl)pyrazoline, 1-[pyridyl(2)]-3-(p-diethylaminostyryl)-5-(p-diethylaminophenyl)pyrazoline, 1-[6-methoxypyridyl(2)]-3-(p-diethylaminostyryl)-5-(p-diethylaminophenyl)-pyrazoline, 1[pyridyl(3)]-3-(p-diethylaminostyryl)-5-(p-diethylaminophenyl)pyrazoline, 1-[pyridyl(2)]-3-(p-diethylaminostyryl)-4-methyl-5-(p-diethylaminophenyl)-pyrazoline, 1-[pyridyl(2)]-3-(α-methyl-p-diethylaminostyryl)-5-p-diethylaminophenyl)pyrazoline, 1-phenyl-3-(p-diethylaminostyryl)-4-methyl-5-(p-diethylaminophenyl)-pyrazoline, 1-phenyl-3-(α-benzyl-p-diethylaminostyryl)-5-(p-diethylaminophenyl)pyrazoline and spiropyrazoline, oxazole compounds such as 2-(p-diethylaminostyryl)-6-diethylaminobenzoxazole and 2-(p-diethylaminophenyl)-4-(p-dimethylaminophenyl)-5-(2-chlorophenyl)oxazole, thiazole compounds such as 2-(p-diethylaminostyryl)-6-diethylaminobenzothiazole, triarylmethane compounds such as bis(4-diethylamino-2-methylphenyl)-phenylmethane, polyarylalkanes such as 1,1-bis(4-N,N-diethylamino-2-methylphenyl)heptane and 1,1,2,2-tetrakis(4-N,N-dimethylamino-2-methylphenyl)ethane, triphenylamine, poly-N-vinyl carbazole, polyvinyl pyrene, polyvinyl anthracene, polyvinyl acridine, poly-9 vinyl phenylanthracene, pyreneformamide resin, ethylcarbazole formaldehyde resin, etc.

In the present invention, one kind or more kinds of the above charge transporting materials can be used in the respective charge transport layers.

The electrophotographic photosensitive member of the present invention is characterized in that the charge transport layers containing respectively the charge transporting materials as mentioned above are laminated, and that a charge transporting material having higher oxidation potential than the charge transporting material used in the first charge transport layer is used in the second charge transport layer serving as a surface layer, whereby the adsorption or oxidation by the active components such as ozone or others can be prevented.

The difference between the oxidation potential of the charge transporting material used in the second charge transport layer and that of the charge transporting material used in the first charge transport layer is preferably 0.1 to 0.5 (V). Oxidation potential difference less than 0.1 (V) may result in decrease in the improvement effect of the present invention, and that more than 0.5 (V) may cause decrease in the sensitivity.

The first charge transport layer may have a film thickness preferably of from 3 μm to 30 μm, more preferably 6 μm to 20 μm.

The second charge transport layer may have a film thickness preferably of from 0.5 μm to 15 μm, more preferably 1 μm to 12 μm. However, the sensitivity may be lowered when the thickness of the second charge transport layer accounts for 80% or more of the total thickness of the charge transport layers.

When the charge transporting material has no film-forming properties, the film formation can be achieved by selecting a suitable binder. Resin usable as a binder may include, for example, resins having insulating properties such as acrylic resin, polyarylate, polyester, polycarbonate, polystyrene, an acrylonitrile/styrene copolymer, an acrylonitrile/butadiene copolymer, polyvinyl butyral, polyvinyl formal, polysulfone, polyacrylamide, polyamide and chlorinated rubber, or organic photoconductive polymers such as poly-N-vinyl carbazole, polyvinyl anthracene and polyvinyl pyrene.

Coating may be carried out according to the coating methods as mentioned above, with use of a solution obtained by dissolving the charge transporting material and the above binder resin in a suitable solvent.

The photosensitive layer constituted of a lamination structure comprising such a charge generation layer and charge transport layers may be provided on a conductive support. As the conductive support, there can be used a support such that the support itself has the conductivity, for example, supports made of aluminum, an aluminum alloy, copper, zinc, stainless stell, vanadium, molybdenum, chrome, titanium, nickel, indium, gold or platinum. Besides these, there can be used plastics (for example, polyethylene, polypropylene, polyvinyl chloride, polyethylene terephthalate, acrylic resins, polyethylene fluoride, etc.) having a layer which has been coat-formed by vacuum deposition of aluminum, an aluminum alloy, indium oxide, tin oxide, an indium oxide/tin oxide alloy or the like. There can be also used supports made of aluminum, an aluminum alloy, plastics, etc. provided thereon with a conductive layer formed by dispersing conductive particles (for example, carbon black, silver particles, titanium oxide powder) in a suitable binder; a support formed by impregnating plastics or paper with conductive particles; plastics containing a conductive polymer; etc.

A subbing layer having a function as a barrier and a function of adhesion can be provided between the conductive support and the photosensitive layer. The subbing layer can be formed using casein, polyvinyl alcohol, nitrocellulose, an ethylene/acrylic acid copolymer, polyamide (such as nylon 6, nylon 66, nylon 610, a copolymer nylon, and an alkoxymethylated nylon), polyurethane, gelatin, aluminum oxide, etc.

The subbing layer may suitably have a film thickness of 0.1 μm to 5 μm, preferably 0.3 μm to 3 μm.

When the charge transporting material comprises an electron transporting material in an embodiment where a photosensitive member obtained by laminating the conductive support, the charge generation layer and the charge transport layer in this order is used, the surface of the charge transport layer needs to be positively charged, and, upon exposure after having been charged, electrons formed in the charge generation layer are injected in the charge transport layer at an exposed portion, and thereafter reach the surface to neutralize the positive charge, thereby causing decay of surface potential to give an electrostatic contrast between the exposed portion and an unexposed portion. An electrostatic latent image thus formed may be developed with a negatively chargeable toner to obtain a visible image. The image formed may be directly fixed, or may be transferred to paper or a plastic film, followed by developing and fixing.

Also, there can be employed a method in which the electrostatic latent image on the photosensitive member is transferred onto an insulating layer of a transfer sheet, and thereafter developed and fixed. As for the kind of a developing agent, or the developing method and the fixing method, may of those conventionally known or available may be employed, without any limitation to specific ones.

On the other hand, when the charge transporting material comprises a hole transporting material, the surface of the charge transport layer needs to be negatively charged, and, upon exposure after having been charged, holes formed in the charge generation layer are injected in the charge transport layer at an exposed portion, and thereafter reach the surface to neutralize the negative charge, thereby causing decay of surface potential to give an electrostatic contrast between the exposed portion and an unexposed portion. At the time of developing, a positively chargeable toner needs to be used, contrary to the case where the electron transporting material is used.

In the present invention, measurement of the oxidation potential was carried out according to the cyclic voltametry. In that case, a platinum electrode was used as a work electrode, a platinum wire as an opposite electrode, a saturated calomel electrode as reference electrode, and a 0.1 N $(n-Bu)_4N^+ClO_4^-$ acetonitrile solution as an electrolyte.

According to the present invention, charge transport layers respectively containing charge transporting materials having different oxidation potential are laminated on a charge generation layer successively from the layer containing the charge transporting material having lower oxidation potential, whereby it can provide an electrophotographic photosensitive member that may not cause any blur or background fog of an image even after repeated use and at the same time has a high sensitivity.

This invention will be described in further greater detail by the following Examples.

EXAMPLE 1

Five grams (5 g) of a disazo pigment represented by Structural Formula (1) shown below were dispersed for 10 hours together with a solution comprising 2.5 g of butyral resin (trademark: S-Lec BM-2; produced by Sekisui Chemical Co., ltd.) and 100 g of tetrahydrofuran by means of a sand mill.

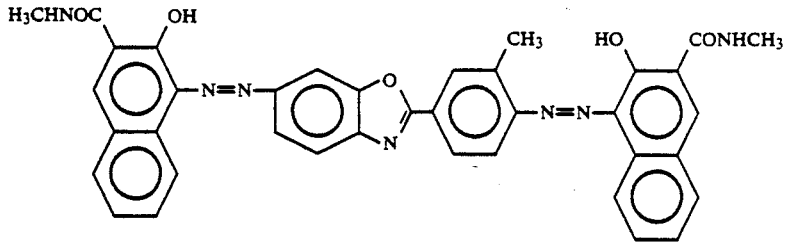

(1)

The resulting dispersion was applied on an aluminum support provided with a subbing layer of 1 μm thick comprising casein by use of a Meyer bar to form a charge generation layer of 0.2 μm thick after dried.

Subsequently, a solution obtained by dissolving 5 g of a charge transporting material (oxidation potential: 0.50 V) represented by Structural Formula (2) shown below and 5 g of polycarbonate resin in 35 g of 1,2-dichloroethane was applied thereon using a Meyer bar, followed by drying at 100 ° C. for 30 minutes to provide a first charge transport layer having a film thickness of 15 μm.

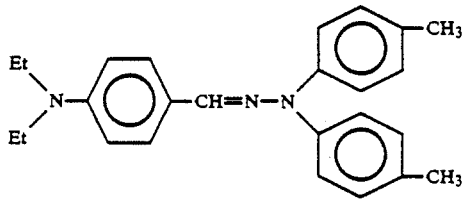

(2)

On this layer, a solution obtained by dissolving 5 g of a charge transporting material (oxidation potential: (0.83 V) represented by Structural Formula (3) shown below and 5 g of polycarbonate resin in monochlorobenzene was applied by spray coating, followed by drying at 100 ° C. for 60 minutes to form a second charge transport layer having a film thickness of 3 μm, thereby producing Sample (1) for the electrophotographic photosensitive member of the present invention.

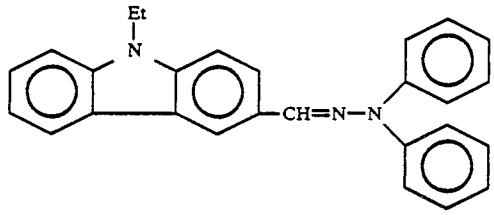

(3)

On the other hand, for comparison, a solution obtained by dissolving 5 g of the charge transporting material represented by Structural Formula (2) and 5 g of polycarbonate resin in 1,2-dichloroethane was applied on the above charge generation layer by use of a Meyer bar to form a charge transport layer having a film thickness of 18 μm, thereby producing comparative Sample (1). There was also prepared Comparative Example (2) produced in the quite same manner as for Comparative Sample (1) except that the charge transporting material represented by Structural Formula (3) was used.

The electrophotographic photosensitive members thus produced were corona charged at −5 kV according to a static system with use of an electrostatic copying paper test device (Model SP-428, produced by Kawaguchi Electric Co., Ltd.), and kept for 1 second in a dark place, followed by exposed at an illumination intensity of 5 lux to examine the charging characteristics. As the charging characteristics, there were measured the surface potential (Vo), the potential (Vd) after dark decaying for 1 second and the exposure amount ($E_{\frac{1}{2}}$) necessary for decaying this potential to ½. Results obtained are shown in Table 1.

TABLE 1

| Photosensitive member | Vo (−V) | Vd (−V) | $E_{\frac{1}{2}}$ (lux · sec) |
|---|---|---|---|
| Sample (1) | 720 | 700 | 2.4 |
| Comparative Sample (1) | 710 | 695 | 2.3 |
| Comparative Sample (2) | 705 | 700 | 3.7 |

It is seen that comparative Sample (2) employing only the charge transporting material having higher oxidation potential causes great fall in sensitivity relative to Comparative Sample (1), while, in Sample (1) according to the present invention, in which the layer containing the charge transporting material having higher oxidation potential is laminated as a surface layer, no fall in sensitivity is caused at all relative to Comparative Sample (1).

Next, these photosensitive members each were fixed on a cylinder for a photosensitive drum of a PPC copying machine NP-150Z produced by Canon to carry out continuous copying for 50,000 sheets, and variations of light portion potential ($V_L$) and dark portion potential ($V_D$) at an initial stage and after 50,000 sheet copying were measured. Results obtained are shown in Table 2.

TABLE 2

| Photosensitive member | Initial stage | | After 50,000 sheet copying | | | |
|---|---|---|---|---|---|---|
| | $V_D$ (−V) | $V_L$ (−V) | $V_D$ (−V) | $V_L$ (−V) | Blur | Ground fog |
| Sample (1) | 730 | 190 | 720 | 220 | none | none |
| Comparative sample (1) | 720 | 180 | 700 | 320 | great | great |
| Comparative sample (2) | 740 | 250 | 715 | 275 | none | none |

It is seen that Sample (1) of the photosensitive member of the present invention shows very small variation in light portion potential and stable potential characteristics as compared with Comparative Sample (1). Also, comparing the images formed after 50,000 sheet copying, images were greatly blurred in Comparative Example (1), while not at all in Sample (1) to give sharp images.

It is seen from the above results that the electrophotographic photosensitive member of the present invention can improve the blur of image or potential variation to be caused after repeated use, without impairing the sensitivity at the initial stage.

EXAMPLE 2

Photosensitive members were produced in the quite same manner as in Example 1, except that a compound (oxidation potential: 0.40 V) of Structural Formula (4) shown below was used as a charge transporting material of the first charge transport layer, and compounds as shown in Table 3 were used as a charge transporting material of the second charge transport layer, to examine the initial stage sensitivity and the potential variations after 50,000 sheet copying in the same manner as in Example 1.

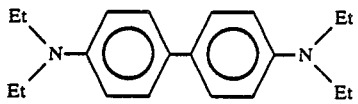

(4)

For comparison, prepared was Comparative Sample (3) not provided with the second charge transport layer to make similar evaluations on it. Results obtained are shown in Table 4.

TABLE 3

| Sample of photosensitive member | Charge transporting material used in second charge transporting layer | Oxidation potential |
|---|---|---|
| (2) | 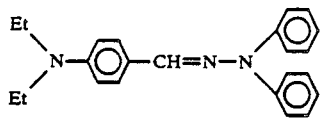 | 0.55 |
| (3) | 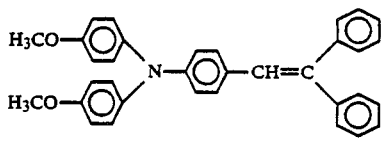 | 0.66 |
| (4) | 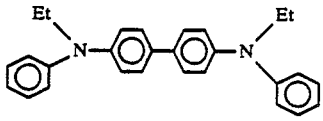 | 0.69 |
| (5) | 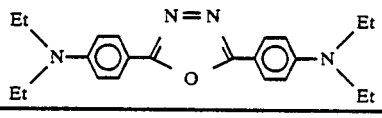 | 0.88 |

TABLE 4

| Photosensitive member | $V_o$ (−V) | $V_d$ (−V) | $E_{\frac{1}{2}}$ (lux · sec) | Initial stage $V_D$(−V) | Initial stage $V_L$(−V) | After 50,000 sheet copying $V_D$(−V) | After 50,000 sheet copying $V_L$(−V) | After 50,000 sheet copying Blur | After 50,000 sheet copying Ground fog |
|---|---|---|---|---|---|---|---|---|---|
| Comparative Sample (3) | 720 | 700 | 2.6 | 740 | 200 | 710 | 380 | great | great |
| Sample (2) | 710 | 700 | 2.7 | 730 | 210 | 710 | 300 | none | none |
| Sample (3) | 705 | 700 | 2.5 | 740 | 195 | 730 | 250 | none | none |
| Sample (4) | 710 | 695 | 2.6 | 735 | 200 | 720 | 250 | none | none |
| Sample (5) | 715 | 705 | 2.8 | 740 | 205 | 730 | 245 | none | none |

EXAMPLE 3

In Example 1, the film thickness of the first charge transport layer and the second charge transport layer was varied to make evaluations in the quite same manner as in Example 1 and study the effect of the invention. Results obtained was shown in Table 5.

TABLE 5

| First charge transport layer Film thickness (μm) | Second charge transport layer Film thickness (μm) | $E_{\frac{1}{2}}$ (lux · sec) | Initial stage $V_D$(−V) | Initial stage $V_L$(−V) | After 50,000 sheet copying $V_D$(−V) | After 50,000 sheet copying $V_L$(−V) |
|---|---|---|---|---|---|---|
| 18 | 0 | 2.3 | 720 | 180 | 700 | 320 |
| 17.5 | 0.5 | 2.3 | 710 | 170 | 710 | 300 |
| 17 | 1 | 2.4 | 725 | 185 | 710 | 260 |
| 15 | 3 | 2.3 | 730 | 190 | 720 | 220 |
| 12 | 6 | 2.5 | 705 | 200 | 685 | 235 |
| 9 | 9 | 2.4 | 710 | 195 | 680 | 230 |
| 6 | 12 | 2.5 | 700 | 190 | 685 | 215 |
| 3 | 15 | 3.0 | 710 | 220 | 700 | 240 |
| 0 | 18 | 3.7 | 740 | 250 | 715 | 275 |

What is claimed is:

1. An electrophotographic photosensitive member comprising a conductive support, and at least a charge generation layer, a first charge transport layer containing a charge transporting material, and a second charge transport layer containing a charge transporting material having higher oxidation potential than that of the charge transporting material contained in said first charge transport layer, which layers are successively laminated on said conductive support.

2. The electrophotographic photosensitive member according to claim 1, wherein the oxidation potential difference between said charge transporting materials is 0.1 to 0.5 (V).

3. The electrophotographic photosensitive member according to claim 1, wherein said first charge transport layer has a film thickness of 3 to 30 μm.

4. The electrophotographic photosensitive member according to claim 3, wherein said first charge transport layer has a film thickness of 6 to 20 μm.

5. The electrophotographic photosensitive member according to claim 1, wherein said second charge transport layer has a film thickness of 0.5 to 15 μm.

6. The electrophotographic photosensitive member according to claim 5, wherein said second charge transport layer has a film thickness of 1 to 12 μm.

7. The electrophotographic photosensitive member according to claim 1, wherein said second charge transport layer has a film thickness accounting for 80% or less of the total film thickness of the charge transport layers.

8. The electrophotographic photosensitive member according to claim 7, wherein said second charge transport layer has a film thickness accounting for not less than 5% and not more than 70% of the total film thickness of the charge transport layers.

* * * * *